US009011205B2

(12) United States Patent
Bewlay et al.

(10) Patent No.: US 9,011,205 B2
(45) **Date of Patent: *Apr. 21, 2015**

(54) TITANIUM ALUMINIDE ARTICLE WITH IMPROVED SURFACE FINISH

(75) Inventors: Bernard Patrick Bewlay, Niskayuna, NY (US); Jonathan Sebastian Janssen, Clifton Park, NY (US); Bin Wei, Clifton Park, NY (US); Youdong Zhou, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 334 days.

This patent is subject to a terminal disclaimer.

(21) Appl. No.: 13/396,908

(22) Filed: Feb. 15, 2012

(65) Prior Publication Data

US 2013/0210320 A1 Aug. 15, 2013

(51) Int. Cl.
*B24C 1/00* (2006.01)
*B24C 1/04* (2006.01)

(52) U.S. Cl.
CPC ..... *B24C 1/04* (2013.01)

(58) Field of Classification Search
CPC ..... B24C 1/08; B24C 1/00; B24C 1/10; B24B 1/06; B24B 39/06; C21D 7/06
USPC ..... 416/241 R; 438/645; 72/39; 83/53; 216/92; 156/345; 428/161; 451/99, 78, 451/36; 134/22.1
See application file for complete search history.

(56) References Cited

U.S. PATENT DOCUMENTS 2,781,261 A 2/1957 Kamlet
2,837,426 A 6/1958 Kamlet
2,895,814 A * 7/1959 Clark ..... 216/92
3,084,060 A 4/1963 Baer et al.
3,180,632 A 4/1965 Katz et al.

(Continued)

FOREIGN PATENT DOCUMENTS

CN 101829770 9/2010
DE 19752777 A1 7/1999

(Continued)

OTHER PUBLICATIONS

P.H. Shipway, G. Fowler, I.R. Pashby, Characteristics of the surface of a titanium alloy following milling with abrasive waterjets, Oct. 8, 2004, Wear 258 (2005) 123-132.*

(Continued)

*Primary Examiner* — Joseph J Hail
*Assistant Examiner* — Brian Keller
(74) *Attorney, Agent, or Firm* — Heslin Rothenberg Farley & Mesiti P.C.

(57) ABSTRACT

Titanium-containing articles having improved surface finishes and methods for changing the surface of titanium containing articles, for example by removing overstock, are provided. One example method includes passing a fluid at high pressure across a surface of an titanium aluminide alloy-containing article, for example, a turbine blade, at high linear speed and deforming the surface of the titanium aluminide alloy-containing article, and removing material from the surface of the titanium aluminide alloy-containing article. Though aspects of the invention can be used in fabricating high performance turbine blades, the methods disclosed can be applied to the treatment of any titanium-containing article for which it is difficult to obtain an improved surface finish.

33 Claims, 8 Drawing Sheets

(56) References Cited

U.S. PATENT DOCUMENTS 3,565,643 A 2/1971 Bergna
3,660,075 A 5/1972 Harbur et al.
3,676,161 A 7/1972 Yates
3,734,480 A 5/1973 Zanis et al.
3,787,143 A 1/1974 Carbonnel et al.
3,961,995 A 6/1976 Alliot et al.
3,969,195 A 7/1976 Dötzer et al.
4,028,096 A 6/1977 Banker et al.
4,040,845 A 8/1977 Richerson et al.
4,101,386 A 7/1978 Doetzer et al.
4,148,204 A * 4/1979 Dotzer et al. ..... 72/39
4,356,152 A 10/1982 Berkman et al.
4,661,316 A 4/1987 Hashimoto et al.
4,703,806 A 11/1987 Lassow et al.
4,710,348 A 12/1987 Brupbacher et al.
4,723,764 A 2/1988 Mizuhara
4,740,246 A 4/1988 Feagin
4,746,374 A 5/1988 Froes et al.
4,793,971 A 12/1988 Eckert et al.
4,802,436 A 2/1989 Wilson et al.
4,808,372 A 2/1989 Koczak et al.
4,848,042 A * 7/1989 Smith et al. ..... 451/78
4,892,693 A 1/1990 Perrotta et al.
4,893,743 A 1/1990 Eylon et al.
4,919,886 A 4/1990 Venkataraman et al.
4,951,929 A 8/1990 Schwarz et al.
4,966,225 A 10/1990 Johnson et al.
4,996,175 A 2/1991 Sturgis
5,011,554 A 4/1991 Fleischer
5,090,870 A * 2/1992 Gilliam ..... 416/241 R
5,098,484 A 3/1992 Eylon et al.
5,098,653 A 3/1992 Shyh-Chin
5,102,450 A 4/1992 Huang
5,152,853 A 10/1992 Fleischer
5,190,603 A 3/1993 Nazmy et al.
5,205,984 A 4/1993 Rowe
5,263,530 A 11/1993 Colvin
5,284,620 A 2/1994 Larsen, Jr.
5,287,910 A 2/1994 Colvin et al.
5,296,055 A 3/1994 Matsuda
5,297,615 A 3/1994 Aimone et al.
5,299,619 A 4/1994 Chandley et al.
5,305,817 A 4/1994 Borisov et al.
5,346,184 A 9/1994 Ghosh
5,350,466 A 9/1994 Larsen, Jr. et al.
5,354,351 A 10/1994 Kampe et al.
5,363,603 A * 11/1994 Miller et al. ..... 451/40
5,366,570 A 11/1994 Mazur et al.
5,368,657 A 11/1994 Anderson et al.
5,372,663 A 12/1994 Shibue et al.
5,407,001 A 4/1995 Yasrebi et al.
5,424,027 A 6/1995 Eylon
5,427,173 A 6/1995 Das et al.
5,429,778 A 7/1995 Patel et al.
5,441,574 A * 8/1995 Hansen et al. ..... 134/22.1
5,443,892 A 8/1995 Holcombe et al.
5,453,243 A 9/1995 Hansen et al.
5,476,679 A 12/1995 Lewis et al.
5,503,798 A 4/1996 Singheiser et al.
5,580,403 A 12/1996 Mazur et al.
5,602,197 A 2/1997 Johnson et al.
5,609,470 A 3/1997 Dodd
5,626,179 A 5/1997 Choudhury et al.
5,678,298 A 10/1997 Colvin et al.
5,700,383 A * 12/1997 Feller et al. ..... 438/645
5,704,824 A * 1/1998 Hashish et al. ..... 451/36
5,746,846 A * 5/1998 Kim et al. ..... 148/671
5,749,937 A 5/1998 Detering et al.
5,766,329 A 6/1998 LaSalle et al.
5,776,617 A 7/1998 Brady et al.
5,823,243 A 10/1998 Kelly
5,839,504 A 11/1998 Matsuda
5,908,516 A 6/1999 Nguyn-Dinh
5,942,057 A 8/1999 Hanamura et al.
5,944,088 A 8/1999 Feagin
5,950,706 A 9/1999 Choudhury et al.
5,981,083 A 11/1999 Colvin et al.
5,997,802 A 12/1999 Holcombe, Jr. et al.
6,136,094 A 10/2000 Yamaji et al.
6,174,387 B1 1/2001 Bellows et al.
6,174,495 B1 1/2001 Nishikiori
6,250,366 B1 6/2001 Choudhury et al.
6,283,195 B1 9/2001 Chandley et al.
6,284,389 B1 9/2001 Jones et al.
6,344,106 B1 * 2/2002 Frankoski et al. ..... 156/345.43
6,352,101 B1 3/2002 Ghosh et al.
6,355,362 B1 3/2002 Jones et al.
6,408,929 B2 6/2002 Choudhury et al.
6,409,963 B1 6/2002 Gohres et al.
6,425,504 B1 7/2002 Besser et al.
6,443,212 B1 9/2002 Choudhury et al.
6,488,073 B1 12/2002 Blenkinsop et al.
6,521,059 B1 * 2/2003 Nazmy et al. ..... 148/421
6,524,407 B1 2/2003 Paul et al.
6,596,963 B2 7/2003 Kelly
6,660,109 B2 12/2003 Hajaligol et al.
6,669,791 B2 12/2003 Tetsui et al.
6,705,385 B2 3/2004 Ray et al.
6,723,279 B1 4/2004 Withers et al.
6,746,508 B1 6/2004 Deevi et al.
6,755,239 B2 6/2004 Ray et al.
6,776,214 B2 8/2004 Ray et al.
6,799,626 B2 10/2004 Ray et al.
6,868,814 B2 3/2005 Baur et al.
6,923,934 B2 8/2005 Nishikiori
7,131,303 B1 * 11/2006 Champaigne ..... 72/53
7,157,148 B2 1/2007 Takai et al.
7,181,944 B2 * 2/2007 Wuestefeld et al. ..... 72/53
7,360,579 B2 4/2008 Renkel et al.
7,389,808 B2 6/2008 Renkel et al.
7,389,809 B2 6/2008 Renkel et al.
7,658,004 B2 2/2010 Mielke
7,761,969 B2 7/2010 Bewlay et al.
7,870,670 B2 1/2011 Oehring et al.
8,062,581 B2 11/2011 Bewlay et al.
8,075,713 B2 12/2011 Renkel
8,136,572 B2 3/2012 Renkel
8,136,573 B2 3/2012 Renkel
8,167,023 B2 5/2012 Renkel
8,579,013 B2 11/2013 Bewlay et al.
2002/0108679 A1 8/2002 Chandley et al.
2003/0051780 A1 3/2003 Blenkinsop et al.
2004/0045644 A1 3/2004 Guther et al.
2005/0084407 A1 4/2005 Myrick
2006/0204757 A1 * 9/2006 Ljungberg ..... 428/408
2006/0219825 A1 * 10/2006 Rohring et al. ..... 241/5
2007/0107202 A1 5/2007 Das
2007/0161340 A1 * 7/2007 Webb ..... 451/102
2007/0199676 A1 8/2007 Wolter
2007/0274837 A1 * 11/2007 Taylor et al. ..... 416/241 R
2007/0280328 A1 12/2007 Lee et al.
2008/0003453 A1 1/2008 Ogren
2008/0081213 A1 4/2008 Ito et al.
2008/0156147 A1 7/2008 Kelly et al.
2008/0156453 A1 7/2008 Kelly et al.
2008/0260608 A1 10/2008 Rancoule
2008/0290568 A1 11/2008 Bewlay et al.
2009/0047135 A1 * 2/2009 Nagaraj et al. ..... 416/241 R
2009/0050284 A1 2/2009 Seserko
2009/0071303 A1 * 3/2009 Hashish et al. ..... 83/53
2009/0133850 A1 5/2009 Kelly et al.
2009/0169415 A1 7/2009 Chikugo et al.
2009/0180890 A1 * 7/2009 Holzer et al. ..... 416/241 R
2009/0320661 A1 * 12/2009 Swift et al. ..... 83/53
2009/0321038 A1 12/2009 Renkel
2009/0325468 A1 * 12/2009 El-Wardany et al. ..... 451/38
2010/0089500 A1 4/2010 Renkel
2010/0124872 A1 * 5/2010 Hashish et al. ..... 451/99
2010/0143655 A1 * 6/2010 Rosenzweig et al. ..... 428/161
2011/0081834 A1 * 4/2011 Roth ..... 451/38
2011/0091324 A1 4/2011 Holzschuh
2011/0094705 A1 4/2011 Kelly et al.
2012/0022839 A1 * 1/2012 Valicek et al. ..... 703/2
2012/0231704 A1 * 9/2012 Mase ..... 451/38

(56) References Cited

U.S. PATENT DOCUMENTS

| | | | | |
|---|---|---|---|---|
| 2012/0264355 | A1* | 10/2012 | Mase et al. | 451/38 |
| 2012/0328448 | A1* | 12/2012 | Bunker | 416/241 R |
| 2013/0084190 | A1* | 4/2013 | Bewlay et al. | 416/241 R |
| 2013/0108459 | A1 | 5/2013 | Bewlay et al. | |
| 2013/0224066 | A1 | 8/2013 | Bewlay et al. | |
| 2013/0248061 | A1 | 9/2013 | Kelly et al. | |
| 2013/0251537 | A1 | 9/2013 | Weimer et al. | |

FOREIGN PATENT DOCUMENTS

| | | | |
|---|---|---|---|
| DE | 10125129 | A1 | 1/2003 |
| DE | 102009027019 | A1 | 11/2010 |
| EP | 0096985 | A1 | 12/1983 |
| EP | 0238758 | A2 | 9/1987 |
| EP | 0521516 | A1 | 1/1993 |
| EP | 0529594 | A1 | 3/1993 |
| EP | 0530968 | A1 | 3/1993 |
| EP | 0560070 | A1 | 9/1993 |
| EP | 0753593 | A1 | 1/1997 |
| EP | 1061149 | A1 | 12/2000 |
| EP | 1797977 | A2 | 6/2007 |
| GB | 569852 | | 6/1945 |
| GB | 783411 | A | 9/1957 |
| GB | 2248071 | A | 3/1992 |
| GB | 2440334 | A | 1/2008 |
| JP | 54157780 | | 12/1979 |
| JP | 01139988 | A | 6/1989 |
| JP | 01184392 | A | 7/1989 |
| JP | 03282187 | A | 12/1991 |
| JP | 0499840 | A | 3/1992 |
| JP | 06009290 | | 1/1994 |
| JP | 06179930 | | 6/1994 |
| JP | 06269927 | A | 9/1994 |
| JP | 0789789 | A | 4/1995 |
| JP | 10204555 | A | 8/1998 |
| JP | 11116399 | A | 4/1999 |
| JP | 2001208481 | A | 8/2001 |
| JP | 2003056988 | A | 2/2003 |
| WO | WO8606366 | A1 | 11/1986 |
| WO | WO8803520 | A1 | 5/1988 |
| WO | WO8910982 | A1 | 11/1989 |
| WO | WO9013377 | A1 | 11/1990 |
| WO | WO9630552 | A1 | 10/1996 |
| WO | WO9832557 | A1 | 7/1998 |
| WO | WO9927146 | A1 | 6/1999 |
| WO | WO0044959 | A1 | 8/2000 |
| WO | WO0067541 | A1 | 11/2000 |
| WO | 0100887 | A2 | 1/2001 |
| WO | WO2008049452 | A1 | 5/2008 |
| WO | WO2011048423 | A1 | 4/2011 |

OTHER PUBLICATIONS

M.C. Kong, D.Axinte, W. Voice, Aspects of material removal mechanism in plain waterjet milling on gamma titanium aluminide, Nov. 15, 2009, Journal of Materials Processing Technology, (2009) 573-584.*

F. Boud, C. Carpenter, J. Folkes, P.H. Shipway, Abrasive waterjet cutting of a titanium alloy: The influence of abrasive morphology and mechanical properties on workpiece grit embedment and cut quality, Aug. 6, 2010, Journal of Materials Processing Technology, (2010) 2197-2205.*

M.C. Kong, D. Axinte, Response of titanium aluminide alloy to abrasive waterjet cutting: geomeetricla accuracy and surface integrity issues versus process paremeters, Sep. 4, 2008, IMechE, vol. 223, Part B: J, 19-42.*

Nambiath, Pradeep, Design and Optimization of Abrasive Slurry Feed System, Control Circuit and Jet Drilling Tool for Mining Applications, Missouri University of Science and Technology, ProQuest, UMI Dissertations Publishing, 2008. 3572986.*

U.S. Appl. No. 13/559,656, filed Jul. 27, 2012, titled Crucible and Facecoat Compositions and Methods for Melting Titanium and Titanium Aluminide Alloys.

U.S. Appl. No. 13/891,624, filed May 10, 2013, titled Systems and Methods for Nondestructive Evaluation of Molds and Crucibles Used in Investment Casting.

U.S. Appl. No. 13/752,880, filed Jan. 29, 2013, titled Calcium Hexaluminate-Containing Mold and Facecoat Compositions and Methods for Casting Titanium and Titanium Aluminide Alloys.

U.S. Appl. No. 13/693,155, filed Dec. 4, 2012, titled Crucible and Extrinsic Facecoat Compositions and Methods for Melting Titanium and Titanium Aluminide Alloys.

U.S. Appl. No. 13/598,164, filed Aug. 29, 2012, titled Calcium Titanate Containing Mold Compositions and Methods for Casting Titanium and Titanium Aluminide Alloys.

Mantle, A.L. et al; "Machining of titanium intermetallic," 30th ISTA Materials for Energy-Efficient Vehicles; Paint and Powder Coating Applications in the Automotive Industries; Florence, Italy; Jun. 16-19, 1997; pp. 619-626.

Nishikiori, S. et al; "Effects of Surface Condition on Room Temperature Tensile Properties of Cast TiAl—Fe—V—B Alloy," ISIJ International, vol. 39, Issue 1-2, 1999, pp. 195-201.

Witt, R. H., & Weaver, I.G.; "Titanium PM Components for Airframes," Conference—Titanium Net Shape Technologies, Los Angeles, California, USA, Feb. 26-Mar. 1, 1984, pp. 29-38.

* cited by examiner

TITANIUM ALUMINIDE ARTICLE WITH IMPROVED SURFACE FINISH

BACKGROUND

Modern gas turbines, especially aircraft engines, must satisfy the highest demands with respect to reliability, weight, power, economy, and operating service life. In the development of aircraft engines, the material selection, the search for new suitable materials, as well as the search for new production methods, among other things, play an important role in meeting standards and satisfying the demand.

The materials used for aircraft engines or other gas turbines include titanium alloys, nickel alloys (also called super alloys) and high strength steels. Titanium alloys are generally used for compressor parts, nickel alloys are suitable for the hot parts of the aircraft engine, and the high strength steels are used, for example, for compressor housings and turbine housings. The highly loaded or stressed gas turbine components, such as components for a compressor for example, are typically forged parts. Components for a turbine, on the other hand, are typically embodied as investment cast parts.

It is generally difficult to investment cast titanium and titanium alloys and similar reactive metals in conventional investment molds and achieve good results because of the metal's high affinity for elements such oxygen, nitrogen, and carbon. At elevated temperatures, titanium and its alloys can react with the mold facecoat. Any reaction between the molten alloy and the mold will result in a poor surface finish of the final casting which is caused by gas bubbles. In certain situations the gas bubbles effect the chemistry, microstructure, and properties of the final casting.

Once the final component is produced by casting, machining, or forging, further improvements in surface finish are typically necessary before it can be used in the final application. Asperities and pits on the surfaces of components can reduce aerodynamic performance in turbine blade applications, and increase wear/friction in rotating or reciprocating part applications.

In the case of titanium aluminide turbine blades, the cast airfoils may have regions in the dovetail, airfoil, or shroud that are cast/forged oversize. To machine these thin stock regions to the final dimensions, either mechanical machining (such as milling or grinding) or non-mechanical machining (such as electrochemical machining) are typically used. However, in either case, the costs of tooling and labor are high and result in manufacturing delays.

Moreover, the limited ductility and sensitivity to cracking of alloys, including titanium aluminide cast articles, may prevent the improvement of the surface finish of cast articles using conventional grinding and polishing techniques. Accordingly, there is a need for an intermetallic-based article for use in aerospace applications that has an improved surface finish and associated methods for manufacturing such an article.

SUMMARY

One aspect of the present disclosure is a method for removing material from a titanium aluminide alloy-containing article. The method comprises providing a titanium aluminide alloy-containing article; passing a fluid at high pressure across a surface of said titanium aluminide alloy-containing article; deforming the surface of the titanium aluminide alloy-containing article; and removing material from the titanium aluminide alloy-containing article. In one aspect, the method provides for asperities and pits from the surface of the titanium aluminide alloy-containing article be removed without cracking or damaging the surface of the article. In one aspect, the present disclosure is a titanium aluminide alloy-containing article made according to the process as recited above.

In another aspect, the present disclosure is a method for removing overstock material from the convex surface of an titanium aluminide containing turbine blade, said method comprising: providing a titanium aluminide alloy-containing turbine blade; passing a fluid at high pressure across the convex surface of said titanium aluminide containing turbine blade; and removing about 0.025 mm to about 5.0 mm of overstock material from the convex surface of the titanium aluminide containing turbine blade.

In one embodiment, the fluid at high pressure makes contact with the titanium aluminide microstructure. In another embodiment, the motion of the nozzle from which the fluid at high pressure exits is selected from a group consisting of rotational, translational, oscillatory, or a combination thereof. In one example, the fluid at high pressure is passed at about 5 inches per minute to about 100 inches per minute over the surface of the titanium aluminide alloy-containing article. The fluid, in one example, comprises water, oil, glycol, alcohol, or a combination thereof. In one example, particles ranging from about 50 microns to about 400 microns are suspended in the fluid before the fluid is passed across the surface of the article, and the solids loading of the fluid is about 10% to 40% by mass flow. In one embodiment, the fluid is passed along with or concurrent to passing a medium of particles ranging from about 50 microns to about 400 microns across the surface of the article. In another example, the fluid is passed along with or concurrent to passing a medium of particles across the surface of the article, wherein the fluid further comprises particles ranging from about 50 microns to about 400 microns. The fluid, in one embodiment, may be heated above room temperature prior to passing the fluid across the surface of the article.

The deforming step, can for example, comprise plastically deforming the titanium aluminide alloy. In one embodiment, after the fluid at high pressure is passed across the surface of the titanium aluminide alloy-containing article, the surface of the article is deformed over a depth of less than about 100 microns from the surface of the article and perpendicularly into the article. In a related embodiment, this depth is less than about 10 microns.

The titanium aluminide alloy, in one example, comprises a gamma TiAl based phase and an $\alpha 2$ ($Ti_3Al$) phase. By practicing the presently taught method, the roughness of the surface of the article can be reduced by at least about 50%. In another embodiment, by practicing the presently taught method, the roughness of the surface of the article is reduced by at least about 25%.

In one embodiment, the surface of the titanium aluminide alloy-containing article has an initial roughness of greater than about 100 Ra, and wherein the roughness of the surface of the article is reduced to at least about 50 Ra. In another embodiment, the roughness of the surface of the article is reduced to at least 20 Ra. In one embodiment, fluid at high pressure includes high linear speeds of the fluid of at least 5 inches per minute. In one embodiment, high linear speed comprises at least 50 inches per minute. In another embodiment, high linear speed comprises at least 100 inches per minute. In yet another embodiment, high linear speed comprises at least 1000 inches per minute. In a particular embodiment, the fluid at high pressure is passed at speeds of about 50 inches per minute to about 1000 inches per minute across the surface of the titanium aluminide-containing alloy.

In one embodiment, the titanium aluminide alloy-containing article comprises a titanium aluminide alloy-containing engine. In another embodiment, the titanium aluminide alloy-containing article comprises a titanium aluminide alloy-containing turbine. In one embodiment, the titanium aluminide alloy-containing article comprises a titanium aluminide alloy-containing turbine blade. In one embodiment, the article is a turbine engine blade having an average roughness (Ra) of less than about 20 microinches across at least a portion of the working surface of the blade.

The fluid at high pressure in one example further comprises particles of alumina, garnet, silica, silicon carbide, boron carbide, diamond, tungsten carbide, and compositions thereof. In one example, the fluid at high pressure is passed along with or concurrent to passing a medium of particles ranging from about 50 microns to about 400 microns across the surface of the article. In another example, the fluid at high pressure is passed along with or concurrent to passing a medium of particles ranging from about 20 microns to about 200 microns across the surface of the article. In another embodiment, these particles are from about 50 microns to about 150 microns.

In one embodiment, the roughness of the surface of the article is reduced at least about 25%. In another embodiment, the roughness of the surface of the article is reduced at least about 50%. In one embodiment, the surface has an initial roughness of greater than about 100 Ra, and wherein the roughness of the surface of the article is reduced to about 50 Ra or less after treatment. In one embodiment, the roughness of the surface of the article is reduced to 20 Ra or less after treatment. That is, the improvement comprises reducing the roughness of the surface of the article to about 20 Ra or less. In another embodiment, the improvement comprises reducing the roughness of the surface of the article by more than about 50 Ra. In one embodiment, after treatment, the Ra value is reduced by a factor of about three to a factor of about six. In a particular example, the roughness of the surface of the article after treatment is less than about two microns. In another embodiment, the roughness of the surface of the article after treatment is less than about one micron.

The stabilizing step in one example comprises one or more of fixing, attaching, and binding said titanium aluminide alloy-containing article to the structure. Passing of the fluid at high pressure and/or small particle containing medium, such as garnet, across the surface of the article may comprise interacting the fluid and/or medium at high pressure with phases of the titanium aluminide microstructure.

Another aspect of the present disclosure is a method for changing a surface of a titanium aluminide alloy-containing article, comprising: stabilizing the titanium aluminide alloy-containing article on a structure; passing a fluid across a surface of said stabilized titanium aluminide alloy-article at high linear speed; and deforming both a gamma titanium aluminide based phase and an $\alpha 2$ ($Ti_3Al$) phase of the titanium aluminide alloy, wherein material is removed from the surface of the titanium aluminide alloy-containing article and thereby the surface of the article is changed. In one aspect, the present disclosure is a titanium aluminide alloy-containing article made according to the process as recited above.

In another aspect, the present disclosure is a method for machining the surface of a titanium aluminide alloy-containing article, said method comprising: providing a titanium aluminide alloy-containing article; passing a fluid at high pressure across a surface of said titanium aluminide alloy-containing article; deforming the surface of the titanium aluminide alloy-containing article; and removing material from the surface of the titanium aluminide alloy-containing article.

In another aspect, the present disclosure is a method for removing overstock material from a titanium aluminide alloy-containing article, comprising: providing a titanium aluminide alloy-containing article; passing a fluid at high pressure across a surface of said titanium aluminide alloy-containing article; deforming the surface of the titanium aluminide alloy-containing article; and removing overstock from the article, wherein asperities and pits from the surface of the titanium aluminide alloy-containing article are removed without cracking or damaging the surface of the article.

BRIEF DESCRIPTION OF THE FIGURES

These and other features, aspects, and advantages of the present articles and methods will become better understood when the following detailed description is read with reference to the accompanying drawings in which like characters represent like parts throughout the drawings, and wherein:

FIGS. 1-3 show a setup that was used to remove 0.004" from the trailing edge of a cast titanium aluminide blade.

DETAILED DESCRIPTION

Figure 1:
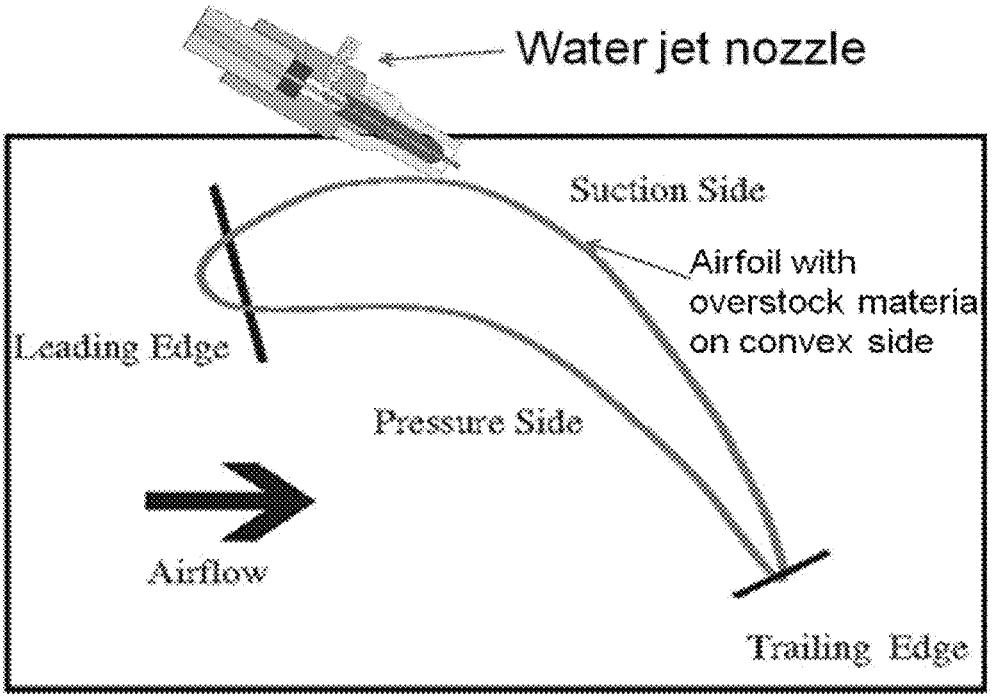
FIG. 1 shows a schematic perspective of the fluid jet nozzle positioned with respect to the airfoil according to one embodiment. In this example, the nozzle is positioned such that the fluid jet interacts with the convex side of the article, such as an airfoil, removing overstock material from the convex side of the article.

The present disclosure relates generally to titanium and titanium alloys containing articles having improved surface finishes, and methods for improving surface finishes on such articles. In one example, the present disclosure relates to turbine blades having improved surface finishes that exhibit superior properties, and methods for producing the same.

Conventional gas and steam turbine blade designs typically have airfoil portions that are made entirely of metal or a composite. The all-metal blades, including costly wide-chord hollow blades, are heavier in weight, resulting in lower fuel performance and requiring sturdier blade attachments. In a gas turbine aircraft application, the gas turbine blades that operate in the hot gas path are exposed to some of the highest temperatures in the gas turbine. Various design schemes have been pursued to increase the longevity and performance of the blades in the hot gas path. As used herein, the term "turbine blade" refers to both steam turbine blades and gas turbine blades.

The instant application discloses that high shear rate local deformation of the surface of a titanium aluminide component, such as a turbine blade, can provide a substantial improvement of the surface finish and improve performance. One aspect is to provide an intermetallic-based article, such as a titanium aluminide based article, with an improved surface finish. In one embodiment, a cast titanium aluminide based article is subjected to a high shear rate surface treatment to improve the surface finish to a roughness of less than 20 microinches (Ra). This new surface treatment improves surface finish and does not introduce any additional damage or cracks in the surface of the component.

In one example, the high rate local shear deformation acts over a depth of less than about 100 microns from the surface into the component. In one embodiment, the high rate local shear deformation acts over a depth of less than about 10 microns from the surface into the component. This method of removing of overstock from the article is new and useful, and is different to steps taken to polish a surface. In one example, to remove material from the surface of the article, a fluid at high pressure is used, wherein the fluid is passed across the surface of the article. In another example, a fluid at high pressure is used with a medium comprising particles that range in size from about 50 microns to 400 microns, wherein the fluid and particle mixture is passed across the surface of the article. One advantage to this approach is that it does not require high-stiffness or heavy tooling to support the part, as is the case for milling.

Surface roughness, often shortened to roughness, is a measure of the texture of a surface. It is quantified by the vertical deviations of a real surface from their calculated mean. If these deviations are large, the surface is rough; if they are small the surface is smooth. Roughness is typically considered to be the high frequency, short wavelength component of a measured surface. Roughness plays an important role in determining how a real object will interact with its environment. For example, rough surfaces usually wear more quickly and have higher friction coefficients than smooth surfaces.

Flaws, waviness, roughness and lay, taken collectively, are the properties which constitute surface texture. Flaws are unintentional, unexpected and unwanted interruptions of topography of the work piece surface. Flaws are typically isolated features, such as burrs, gouges and scratches, and similar features. Roughness refers to the topographical irregularities in the surface texture of high frequency (or short wavelength), at the finest resolution to which the evaluation of the surface of the work piece is evaluated. Waviness refers to the topographical irregularities in the surface texture longer wave lengths, or lower frequency than roughness of the surface of a work piece. Waviness may arise, for example, from machine or work piece vibration or deflection during fabrication, tool chatter and the like.

The term polishing results in a reduction in roughness of work piece surfaces. Lay is the predominant direction of a pattern of a surface texture or a component of surface texture. Roughness and waviness may have different patterns and differing lay on a particular work piece surface.

The inventors of the instant application provide an intermetallic-based article, such as a titanium aluminide based article, with a surface that possesses improved properties, such as reduced roughness and enhanced mechanical integrity. In one aspect, the present technique includes removing material from a titanium aluminide alloy-containing article. The method comprises providing a titanium aluminide alloy-containing article; passing a fluid at high pressure across a surface of said titanium aluminide alloy-containing article; deforming the surface of the titanium aluminide alloy-containing article; and removing material from the titanium aluminide alloy-containing article. By practicing this method, asperities and pits from the surface of the titanium aluminide alloy-containing article were removed without cracking or damaging the surface of the article. In one embodiment, the removing includes removing surface roughness and removing overstock material from the article. In one aspect, the present disclosure is a titanium aluminide alloy-containing article made according to the process as recited above.

Titanium alloys have high relative strength and excellent corrosion resistance, and have mainly been used in the fields of aerospace, deep sea exploration, chemical plants, and the like. One example of a titanium alloy is titanium aluminide. The titanium aluminide alloy typically comprises a gamma titanium aluminide based phase and an $\alpha 2$ ($Ti_3Al$) phase of the titanium aluminide alloy.

The deforming step according to one technique comprises plastically deforming the titanium aluminide alloy; as a result of plastic deformation of the titanium aluminide alloy, at least one of the phases in the alloy is deformed permanently or irreversibly. This deformation of the titanium aluminide alloy is achieved by passing a fluid at high pressure across the surface of the article, causing an interaction of the fluid with the titanium aluminide microstructure. The fluid is passed across the surface of the component at high linear speeds and the resultant high shear rate generates the local surface deformation. In one embodiment, an abrasive medium comprising particles, such as alumina or garnet, are suspended in the fluid prior to the passing of the fluid across the surface of the article. The impact of the mixture, with or without particles, provides the shear necessary to remove asperities without cracking or damaging the surface.

The abrasive medium according to one example is selected from at least one of alumina, garnet, silica, silicon carbide, boron carbide, diamond, tungsten carbide, and compositions thereof. The abrasive medium can also be an abrasive jet of fluid. In certain embodiments, the fluid is an abrasive high pressure jet of fluid and further comprises at least one of alumina, garnet, silica, silicon carbide, boron carbide, diamond, tungsten carbide, and compositions thereof. In one example, the fluid comprises water. In certain embodiments, the harder the abrasive, the faster and more efficient the polishing operation. The reuse of the abrasive medium permits economic use of harder, but more expensive abrasives, with resulting enhancements in the efficiency of polishing and machining operations to increase the polishing rate when required. For example, alumina or silicon carbide may be substituted in polishing operations where garnet is used.

Abrasive water jet polishing in conjunction with 4 or 5 axis manipulation capability provides rapid, efficient, and low-cost means to modify the cast component geometry to comply with the precise requirements for the final part dimensions and the necessary surface finish. The high shear rate local surface deformation is generated by passing the fluid that exits the nozzle at high pressure with or without the abrasive medium across the surface of the article. The motion of the nozzle from which the high pressure fluid exits can be rotational, translational, or oscillatory. For example, using this nozzle, linear speeds in excess of 50 inches per minute may be achieved, and this level of speed in conjunction with abrasive particles of a size range from 50 microns to 400 microns, can lead to substantial removal of material, including overstock, from the surface of the intermetallic alloy article. In one example, the speed of the nozzle ranges between $1\times10^{-3}$ and $10\times10^{-3}$ inches per minute.

In one aspect, the present disclosure is a method for removing overstock material from the convex surface of an titanium aluminide containing turbine blade, the method comprising: providing a titanium aluminide alloy-containing turbine blade; passing a fluid at high pressure across the convex surface of the titanium aluminide containing turbine blade; and removing overstock material from the convex surface of the titanium aluminide containing turbine blade. According to one example, 0.025 mm to 5 mm of material is removed by the kerf at a prescribed distance from the nozzle exit. According to one example, 0.5 mm to 3 mm of material is removed by the kerf at a prescribed distance from the nozzle exit. In one example, about 1 mm to 2 mm of material is removed.

In one example, the gap between the nozzle from which the fluid exits at high pressure and the surface of a work piece, such as for example a turbine blade, is about 0.1 cm to about 5.0 cm. In a related embodiment, the distance between the nozzle and the surface of the work piece is about 0.1 cm, 1.0 cm, 1.5 cm, 2 cm, or 2.5 cm. This distance can be adjusted to suit the requirements for any given piece. For example, if all other variables are kept constant, the closer the nozzle opening is to the surface of the work piece, the higher the impact of the fluid exiting the nozzle and interacting and coming in contact with the surface of the work piece. The closer the nozzle, the narrower the kerf—the more well-defined the jet, so higher accuracy is possible but is counteracted by exponentially higher material removal rate. Conversely, if the nozzle is further away from the work piece, the rate and/or amount of material that can be removed is less than if the nozzle is kept in much closer proximity with the surface of the portion of the work piece that is to be removed. Similarly, the angle at which the fluid that exits the nozzle opening contacts the surface of the work piece is a factor at determining the rate and/or amount of material that is removed from the surface of the work piece. The work piece, such as a turbine blade or another titanium aluminide alloy-containing article, in one example, is fixed and the nozzle moves relative to the surface of the work piece (see FIG. 1-3).

In accordance with the teachings herein, the fluid is discharged at high pressure from the nozzle, with or without the abrasive medium, and passes across the surface of the titanium aluminide alloy-containing article. The pressure typically is at about 5000 to about 10,000 pounds per square inch on the surface. In one embodiment, the pressure on the surface is at about 40,000 to about 80,000 pounds per square inch. In another embodiment, the pressure of the fluid at the nozzle opening is at about 80,000 pounds per square inch to about 150,000 pounds per square inch. The shear forces generated by the interaction between the article surface and the high pressure fluid generates local flow of the intermetallic material without cracking or damaging the surface. This process removes asperities and removes pits in the surface. The titanium aluminide alloy-containing article or work piece comprises a titanium aluminide alloy-containing engine, a turbine, or a turbine blade.

The passing step can include, in one example, a two step process or up to a five step process. For example, the passing step includes passing different sizes of the abrasive medium suspended in a fluid and this fluid is then passed at high speed across the surface of the titanium aluminide alloy-containing article. The size of the particles that make up the abrasive medium is an aspect of the disclosure. For example, the passing step comprises suspending different sized particles in the fluid and then passing a first abrasive medium of particles that are suspended in the fluid and range from about 140 microns to about 195 microns across the surface, then passing a second abrasive medium of particles that are suspended in the fluid and range from about 115 microns to about 145 microns across the surface, and then passing a third abrasive medium of particles that are suspended in the fluid and range from about 40 microns to about 60 microns across the surface.

The abrasive medium of different sizes, in one example, are suspended in the fluid sequentially and the fluid is passed at high speed across the surface of the article such that decreasing size of particles come in contact with the surface of the article over the period of time that the fluid is passed over the article's surface. For example, the passing step comprises first passing an abrasive medium of particles suspended in a fluid and ranging from about 70 microns to about 300 microns across the surface, followed by passing an abrasive medium of particles suspended in a fluid and ranging from about 20 microns to about 60 microns across the surface. In another example, the passing step comprises first passing an abrasive medium of particles suspended in a fluid and ranging from about 140 microns to about 340 microns across the surface, followed by passing an abrasive medium of particles suspended in a fluid and ranging from about 80 microns to about 140 microns across the surface, and further followed by passing an abrasive medium of particles suspended in a fluid and ranging from about 20 microns to about 80 microns across the surface.

In a particular embodiment, the third or final pass of the abrasive medium involves passing particles suspended in a fluid and ranging from about 5 microns to about 20 microns across the surface. In a particular embodiment, the final pass of the abrasive medium involves passing particles suspended in a fluid and ranging from about 10 microns to about 40 microns across the surface. In a related embodiment, the final pass of the abrasive medium may be the second, third, fourth, or fifth pass of the suspended abrasive medium across the surface. In one embodiment, the units for the particles reflect the size of the particle. In another embodiment, the units for the particles reflect the outside dimension of the particle, such as width or diameter. In certain embodiments, the abrasive medium can be the same composition of matter with different sizes across the surface, or it can be one or more different compositions of matter. For example, the abrasive medium is alumina particles of varying size, or a mixture of alumina particles and garnet of varying size.

The particle size of the abrasive according to an exemplary embodiment should be the smallest size consistent with the required rate of working, in light of the hardness and roughness of the surface to be worked and the surface finish to be attained. In general terms, the smaller the particle or "grit" size of the abrasive, smaller pieces of particles can be removed and a smoother surface is obtained attained. The abrasive will most often have a particle size of from as low as about 50 microns up to about 600 microns. More commonly, the abrasive grain size will be in the range of from about 100 to about 300 microns.

The fluid, in one example, is selected from a group consisting of water, oil, glycol, alcohol, or a combination thereof. In one example, particles ranging from about 50 microns to about 400 microns are entrained in the fluid before the fluid is passed across the surface of the article, and the solids loading of the fluid is about 10% to about 40% by mass. In one embodiment, the solids loading of the fluid is about 5% to about 50%. In another embodiment, the solids loading of the fluid is about 15% to about 30%. In one embodiment, the solids loading of the fluid is about 2000 grams per liter to about 5000 grams per liter.

As well as the size of the particles constituting the abrasive medium, the speed of the particles across the surface of the article and the duration of time for each passing step are controlled. In one embodiment, the passing speed is such that it takes less than one minute for the particles to pass across one foot of the article. In another embodiment, it takes between 10 seconds to 40 seconds for the particles to pass across one foot of the article. In another embodiment, it takes between 1 second to 20 seconds for the particles to pass one foot of the article.

In one aspect, the fluid at high pressure has a high linear speed. This high linear speed comprises at least 50 inches per minute, in another example is at least 100 inches per minute, and in another example is at least 1000 inches per minute. This refers to the linear speed of the jet in the direction of the travel of the cutting head as the cutting head moves. In certain embodiments, the fluid with the abrasive medium is passed across the surface of the titanium aluminide alloy-containing article at high linear speeds of about 50 inches per minute to about 1000 inches per minute. Where the linear speed describes the velocity of the jet itself, in one example, the velocity is from about 200 m/s to about 1000 m/s, and in another example is from about 300 m/s to about 700 m/s. The fluid with the abrasive medium, in one example, is passed across the surface of the article and interacts with the titanium aluminide microstructure.

The presently taught method for the high shear rate removal of material from the titanium aluminide containing article's surface allows smoothing of the surface and elimination of asperities and pits on the surface of the article. That is, the presently taught methods allow material to be removed from the article without generating surface cracks or other damage on the surface of the article. Only local plastic deformation of the titanium aluminide containing-alloy occurs, typically over a depth of 10-150 microns, according to the teachings of the present disclosure. However, this is in contrast to techniques where at least one phase of the titanium aluminide containing-alloy is plastically deformed. In one embodiment, the fluid is heated above room temperature prior to passing the fluid across the surface of the article. A feature of the present technique is the manner in which the surface deformation process interacts with the phases in the alloy microstructure beneath the surface.

The passing and deforming steps of the presently taught method may be sequentially repeated, until the desired removal of material from the surface of the article or the desired roughness value is achieved. In one example, it is desired that the surface of high performance articles, such as turbine blades, turbine vanes/nozzles, turbochargers, reciprocating engine valves, pistons, and the like, have a roughness (Ra) of about 20 microinches or less. In some instances, the passing and deforming steps are sequentially repeated at least two times. In some instances, the passing and deforming steps are sequentially repeated multiple times with a fluid suspension comprising abrasive medium of varying size or of sequentially decreasing size. This is performed until the desired surface finish is obtained. For example, the passing step comprises passing a first abrasive medium of particles suspended in a fluid and ranging from about 140 microns to about 195 microns across the surface, then passing a second abrasive medium of particles suspended in a fluid and ranging from about 115 microns to about 145 microns across the surface, and then passing a third abrasive medium of particles suspended in a fluid and ranging from about 40 microns to about 60 microns across the surface.

In contrast to the presently taught method, typically, surface finishing of titanium aluminide components is performed by multi-axis milling, grinding, abrasive polishing, tumbling processes, or chemical polishing. In contrast to the presently taught method, the mechanical methods present a risk of surface damage, while the chemical methods are time-consuming. There are limitations to this conventional processing on the surface finish that can be generated consistently. The forces introduced by these bulk machining techniques can introduce undesirable stresses that can lead to surface cracking of the components. The limited ductility and sensitivity to cracking of typical titanium aluminide cast articles limit the improvement of the surface finish of cast articles using conventional grinding and polishing techniques. The present techniques provide for improved surface finish with greatly reduced risk of the aforementioned disadvantages.

Another aspect of the present disclosure is a method for changing a surface of a titanium aluminide alloy-containing article. In one embodiment, this comprises stabilizing the titanium aluminide alloy-containing article on a structure; passing a fluid across a surface of the stabilized titanium aluminide alloy-article at high linear speed; and deforming both a gamma titanium aluminide based phase and an $\alpha 2$ ($Ti_3Al$) phase of the titanium aluminide alloy, wherein material is removed from the surface of the titanium aluminide alloy-containing article and thereby the surface of the article is changed. The stabilizing step in one example comprises one or more of fixing, attaching, and binding said titanium aluminide alloy-containing article to the structure. Passing the fluid comprising the abrasive medium across the surface of the article, wherein there is an interaction between the fluid comprising the abrasive medium and the phases of the titanium aluminide microstructure. In one aspect, the present disclosure is a titanium aluminide alloy-containing article made according to the process as recited above. In one embodiment, the titanium aluminide alloy-containing article comprises a titanium aluminide alloy-containing engine, titanium aluminide alloy-containing turbine, or a titanium aluminide alloy-containing turbine blade.

In another aspect, the present disclosure is a method for machining the surface of a titanium aluminide alloy-containing article, the method comprising: providing a titanium aluminide alloy-containing article; passing a fluid at high pressure across a surface of the titanium aluminide alloy-containing article; deforming the surface of the titanium aluminide alloy-containing article; and removing material from the surface of the titanium aluminide alloy-containing article.

In another aspect, the present disclosure is a method for removing overstock material from a titanium aluminide alloy-containing article, comprising: providing a titanium aluminide alloy-containing article; passing a fluid at high pressure across a surface of the titanium aluminide alloy-containing article; deforming the surface of the titanium aluminide alloy-containing article; and removing overstock from the article, wherein asperities and pits from the surface of the titanium aluminide alloy-containing article are also removed without cracking or damaging the surface of the article.

Another aspect of the present technique is a method for reducing the Ra value of the surface of a titanium aluminide alloy-containing article, comprising: stabilizing the titanium aluminide alloy on a structure; passing at high pressure sequentially decreasing grit sizes suspended in a fluid across the surface of the stabilized titanium aluminide alloy at high speeds; and deforming both the TiAl based phase and the α2 ($Ti_3Al$) phase of the titanium aluminide alloy plastically, and thereby reducing the Ra value of the surface of the titanium aluminide alloy.

An example of the present technique involves removing material, for example excess overstock material (see for e.g. FIGS. 1-3) from the surface of titanium aluminide containing articles that have been produced by casting. Depending on the type of particle used and their size and conditions including how long the fluid that contains the particles is passed over the article, one can obtain titanium aluminide containing articles that have reduced Ra values compared to before treatment. An Ra value of 70 microinches corresponds to approximately 2 microns; and an Ra value of 35 microinches corresponds to approximately 1 micron. It is typically required that the surface of high performance articles, such as turbine blades, turbine vanes/nozzles, turbochargers, reciprocating engine valves, pistons, and the like, have an Ra of about 20 microinches or less. By practicing the presently taught method, the roughness of the surface of the article is reduced at least about 50%. For example, the surface of the titanium aluminide alloy-containing article has an initial Ra of greater than about 100 microinches, and wherein the Ra of the surface of the article is reduced to about 50 microinches or less after treatment. In one aspect, the present disclosure is a titanium aluminide alloy-containing article, for example a turbine blade, and it has a roughness of less than about one micron across at least a portion of its surface.

In one example, the roughness of the surface of the article after treatment is about 20 microinches Ra or less. In another example, the roughness of the surface of the article after treatment is about 15 microinches Ra or less. In another embodiment, after treatment, the Ra value is reduced to 10 microinches or less. In certain embodiments, after treatment, the Ra value is reduced by a factor of about three to about six. For example, after treatment, the Ra value is reduced by a factor of about five. In one embodiment, the Ra value is improved from a level of 70-100 microinches on a casting before treatment to a level of less than 20 microinches after treatment.

In accordance with the teachings of the present techniques, the roughness of the surface of the article can be reduced at least about 25%. In some instances, the roughness of the surface of the article is reduced at least about 50%. In one embodiment, the roughness of the surface of the article can be reduced by 20% to 80%, when compared to pre-treatment levels. In one embodiment, the roughness of the surface of the article can be reduced by about 2 times, when compared to pre-treatment levels. In one embodiment, the roughness of the surface of the article can be reduced by about 4 times, when compared to pre-treatment levels. In one embodiment, the roughness of the surface of the article can be reduced by about 6 times, when compared to pre-treatment levels. In one embodiment, the roughness of the surface of the article can be reduced by about 8 times, when compared to pre-treatment levels. In one embodiment, the roughness of the surface of the article can be reduced by about 10 times, when compared to pre-treatment levels. In another embodiment, the roughness of the surface of the article can be reduced by about 2 times to about 10 times, when compared to pre-treatment levels.

The surface of the titanium aluminide alloy-containing article may have an initial roughness of greater than about 100 microinches Ra, and after treatment, the roughness of the surface of the article is reduced to about 50 microinches Ra or less. In another embodiment, the roughness of the surface of the article is reduced to about 20 microinches Ra or less. In one embodiment, the surface of the titanium aluminide alloy-containing article has an initial roughness of about 120 microinches Ra, and this roughness is reduced to about 20 microinches Ra after treatment. In one embodiment, the surface of the titanium aluminide alloy-containing article has an initial roughness of about 115 microinches Ra, and this roughness is reduced to about 10 microinches Ra after treatment. In one embodiment, the surface of the titanium aluminide alloy-containing article has an initial roughness of 110 microinches Ra or more, and this roughness is reduced to 30 microinches Ra or less after treatment.

The present embodiment provides a finished article with a substantially defect-free surface. In addition, by practicing the teachings of the present technique, the finished article that is obtained (for example, a turbine blade) has a roughness of less than 50 microinches, and in the alternative less than 10 microinches, across at least a portion of the article's surface.

One aspect is a titanium aluminide alloy-containing article having a roughness of less than about one micron across at least a portion of a surface containing titanium aluminide alloy. In one embodiment, this article is cast article. In one example, the article is an investment cast article. In another example, the article is heat treated or processed by hot isostatic pressing. Hot isostatic pressing (HIP) is a manufacturing process used to reduce the porosity of metals and increase the density of many ceramic materials. This improves the material's mechanical properties and workability. The HIP process subjects a component to both elevated temperature and isostatic gas pressure in a high pressure environment, for example, a containment vessel. Argon is typically used as the pressurizing gas. An inert gas such as Argon is used, so that the article does not chemically react. The chamber is heated, causing the pressure inside the vessel to increase, applying pressure to the article from all directions (hence the term "isostatic"). In one example, the inert gas is applied between 7,350 psi (50.7 MPa) and 45,000 psi (310 MPa), with 15,000 psi (100 MPa) being one example.

The article can be an engine or a turbine. In a specific embodiment, the article is a turbine blade. In another embodiment, the titanium aluminide alloy-containing article comprises a titanium aluminide alloy-containing turbine blade. In one example, the titanium aluminide alloy-containing article is a turbine blade and at least a portion of a working surface of the turbine blade has an Ra roughness of less than about 40 microinches. In another embodiment, the majority of the surface area of the titanium aluminide alloy article is substantially planar and has a roughness of less than about 20 microinches Ra. In a specific embodiment, the article is a turbine engine blade having an average roughness of less than about 15 microinches Ra across at least a portion of the working surface of the blade.

Conventional Abrasive Waterjet (AWJ) is used for cutting metal with the jet completely cutting through the workpiece material. The present disclosure applies a modified version of AWJ to generate a skim cut, or surface polish. The abrasive water jet is set up to skim over the workpiece surface for light cut or polish of the surface of the component. The AWJ process is set up for the purpose of correcting casting overstock errors and finishing machining the part to meet tolerance and surface finishing requirements. The jet is moved relative to the workpiece with a complex tool path to follow the workpiece contour. The relative motion is provided by a multi-axis CNC driver. The jet spatial contour matches the workpiece contour in the machining areas.

Waterjet is an abrasive process and has low cutting forces. Another advantage is that the tooling cost is low. Another advantage of the presently taught method is that the high pressure jet cuts and polishes the material with a high removal rate, leading to low cycle time. Abrasive water jet polishing can also be performed with a jet with a controlled tool path. This is an alternative process to conventional machining and surface polishing approaches.

In general, the abrasive will desirably be employed at concentrations in the formulation at levels of from about 10 to about 30 percent by mass flow. The rate at which work is performed on the article is related to the spatial concentration of the abrasive, and it is appropriate to assure that the concentration is sufficient to attain the process cycle times and productivity for best efficiency in the working of the titanium-containing article. There is no literal lower limit to the abrasive concentration, although it should be kept in mind that the abrasive content is a major determinant of the cutting power of the medium, and when this is too low, the required deformation may not occur. When low concentrations of abrasive are employed, other techniques for attaining the required cutting power may be employed, such as increasing jet pressure and velocity. The surface deformation polishing approach using a fluid at high pressure generates components with improved surface finish and has several advantages in comparison with conventional milling and grinding methods. For example, the present technique provides a fast and simple method for providing an improved surface finish while generating minimal surface defects. The approach has low cost, and is also amenable to high-rate automation.

Typical literature information regarding abrasive water jet cutting, and general knowledge of those skilled in the art, indicates that the random nature of the abrasive particle distribution in a jet prevents the user from having a rough-cutting accuracy better than ±0.010". Thus, Applicants believe the prior art/knowledge of those skilled in the art restricts the AWJ process to rough-cutting of bulk material. Typically, abrasive water jet cutting is used for cutting completely through objects, rather than for surface machining. The present invention describes a new mode of abrasive water jet milling, or machining, that allows removal of small amounts of material (0.001" to 0.020") in a controlled manner. Typical configurations for surface abrasive water jet milling, as described in the present disclosure, are shown for example in FIGS. 1-3.

Contrary to prior practice of those skilled in the art of abrasive water jet cutting, the present disclosure makes direct use of the random nature of the particle distribution in the water jet in conjunction with the high mass flow rate to achieve material removal from the surface of overstock parts, rather than through-thickness cutting. The present invention controls and employs the abrasive water jet kerf. Typically in cutting processes, the 'kerf' is considered to be a feature that results in lost material (the kerf is defined as the width of a groove made by a cutting tool in conventional machining), and is therefore detrimental.

Figure 4:
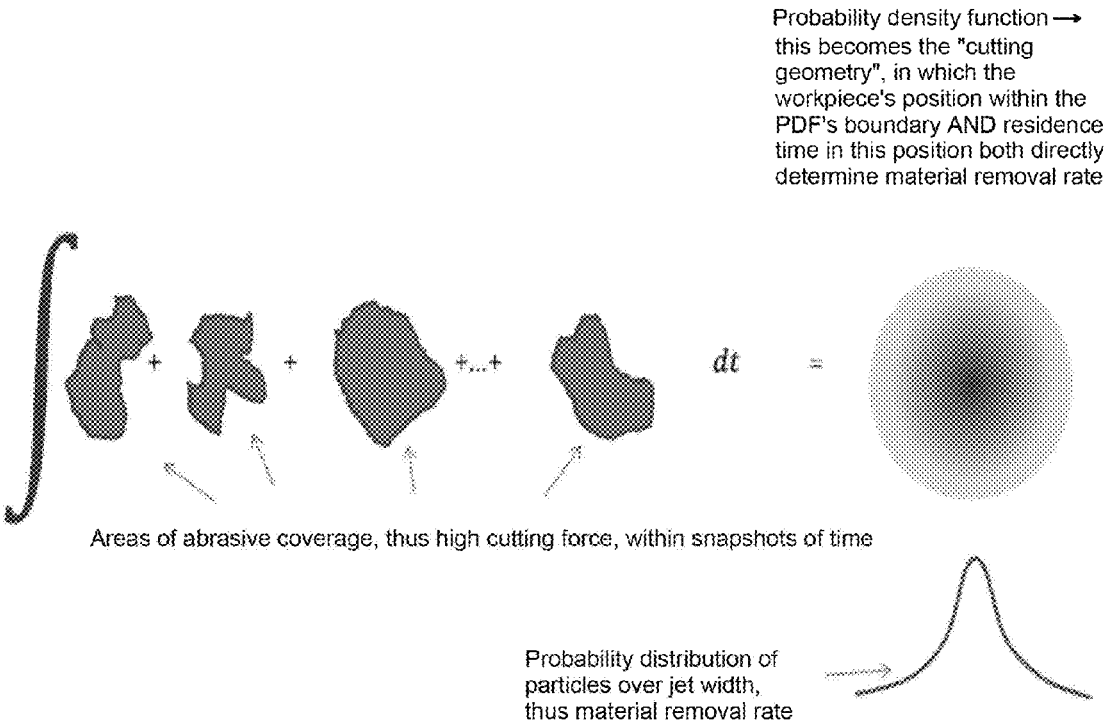
FIG. 4 is a schematic depicting the space-time integral of the cloud patterns that are used to perform abrasive water jet machining.

However, in the present disclosure, the kerf is re-defined as a time-series integral of the spatial distribution of the abrasive in the jet that impinges upon the surface to be machined over a series of different times, as described in FIG. 4. This integrated result is a probability density function (PDF) that is used to describe the cutting geometry. The kerf is controlled so that it can be used constructively to remove excess material from a part in a controlled manner. The cutting geometry is represented much like the side of a conventional milling cutter, except that residence time (which is controlled by the feedrate, or the rate of translation of the jet) directly controls the material removal rate. The control of the jet characteristics and the motion of the jet play a part in controlling the rate of material removal.

EXAMPLES

The techniques, having been generally described, may be more readily understood by reference to the following examples, which are included merely for purposes of illustration of certain aspects and embodiments, and are not intended to limit the system and methods in any way.

A roughness value can either be calculated on a profile or on a surface. The profile roughness parameter (Ra, Rq, . . . ) are more common. Each of the roughness parameters is calculated using a formula for describing the surface. There are many different roughness parameters in use, but $R_a$ is by far the most common. Other common parameters include $R_z$, $R_q$, and $R_{sk}$.

The average roughness, Ra, is expressed in units of height. In the Imperial (English) system, 1 Ra is typically expressed in "millionths" of an inch. This is also referred to as "microinches". The Ra values indicated herein refer to microinches. Amplitude parameters characterize the surface based on the vertical deviations of the roughness profile from the mean line. A profilometer is a device that uses a stylus to trace along the surface of a part and determine its average roughness.

The surface roughness is described by a single number, such as the Ra. There are many different roughness parameters in use, but Ra is the most common. All of these parameters reduce all of the information in a surface profile to a single number. Ra is the arithmetic average of the absolute values and $R_t$ is the range of the collected roughness data points. Ra is one of the most common gauges for surface finish.

The following table provides a comparison of surface roughness, as described using typical measurements of surface roughness.

| Roughness values Ra micrometers | Roughness values Ra microinches | Roughness Grade Numbers |
|---|---|---|
| 50 | 2000 | N12 |
| 25 | 1000 | N11 |
| 12.5 | 500 | N10 |
| 8.3 | 250 | N9 |
| 3.2 | 125 | N8 |
| 1.6 | 63 | N7 |
| 0.8 | 32 | N6 |
| 0.4 | 16 | N5 |
| 0.2 | 8 | N4 |
| 0.1 | 4 | N3 |
| 0.05 | 2 | N2 |
| 0.025 | 1 | N1 |

In one example, the nozzle is set up so that it is almost in contact with the work piece, such as for example a turbine blade, as shown in FIG. 1. Here, the longitudinal axis of the jet that emanates from the nozzle is aligned as shown in FIG. 1 and it is moved with respect to the overstock part in accordance with the contour of the surface that is to be produced after the removal of the material from the cast airfoil with overstock on the convex side. The water jet was set up to provide a jet of fluid, such as for example water, that contains, for example, garnet or yttrium aluminate particles with a size of about 50 to about 600 microns. The high pressure fluid jet used has a circular nozzle orifice diameter of 0.030 inches. The jet is moved relative to work piece with a complex tool path, and the relative motion was provided by a multi-axis CNC driver. The overstock cast part possesses, for example, 1 mm of overstock material only on the convex side of the airfoil.

Figure 2:
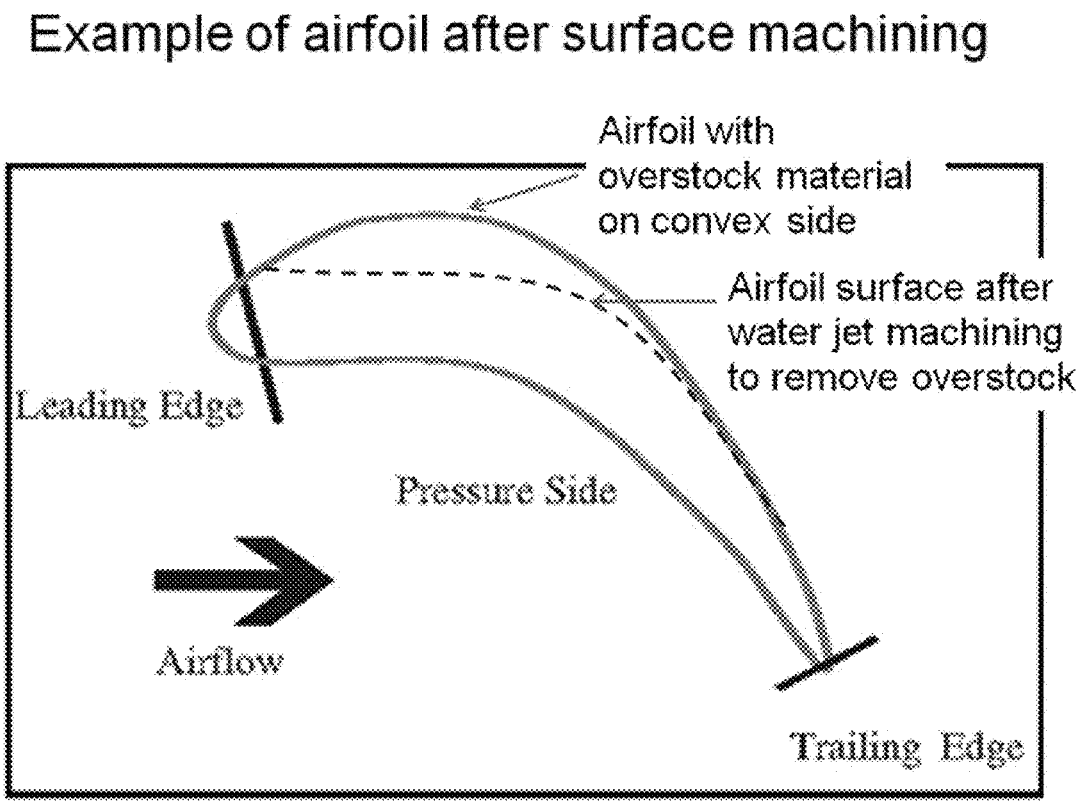
FIG. 2 shows a schematic perspective of the contour of the article from FIG. 1 before and after the high pressure fluid jet treatment according to one embodiment.

The overstock is employed to allow for solidification shrinkage during casting, for reaction with the mold, for reaction with the environment during heat treatment, and to accommodate dimensional variation in the casting that can be accommodated during final machining of the part. The spatial profile of the abrasive fluid jet nozzle is set up to follow the work piece contour in the areas of the blade on the convex surface where the overstock material has to be removed (see FIG. 2, showing an example of the before and after contour). The range of material thicknesses that can be removed with the skim cut is from about 0.05 mm to about 5.0 mm. In a specific example, about 0.1 mm to about 2.5 mm of material can be removed with the skim cut. In one embodiment, nozzles of alternate geometries can be employed, such as a slot rather than a circle; other nozzle geometries that may be more suitable for the contour of the airfoil can also be employed.

In one embodiment, bulk pieces of overstock material were trimmed off the blade with a linear speed of 10 inches/min using 150-300 micron size grit. During this operation, the kerf acts as a saw to remove large blocks of material. In another embodiment, the kerf further from the nozzle jet acts as a diffuse contact mechanism which allows time-controlled cut depth. This experiment was performed by orienting the blade such that is was 10° from the vertical axis. Cuts were made at a slow speed, e.g. 2 in/min, and at oscillating high speed, e.g. 100 in/min back and forth. Evaluative cuts were also performed to determine the influence of the exposure-time variable and its effect on cut depth. The surface roughness of the part was less than 80 microinches Ra, and the amount of material removed was 4 thousandths of an inch.

Figure 3:
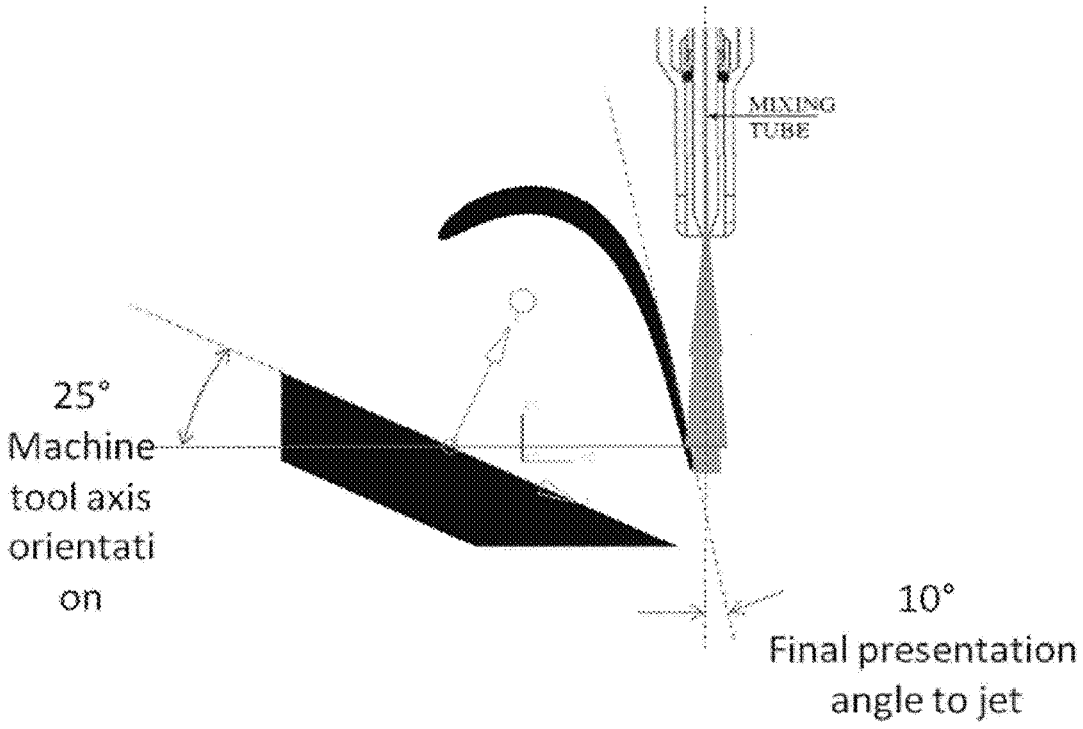
FIG. 3 shows a diagram showing one example of a configuration of the abrasive water jet nozzle in relation to the blade surface that is machined.

Three additional examples are described below of abrasive water jet machining of the trailing edge of a turbine blade to finish machine the part to the final dimensions. FIG. 3 shows an experimental setup that was used to remove 0.004" from the convex face surface of the turbine blade/airfoil in a region within approximately 1" of the trailing edge. The titanium aluminide containing article, in this case a turbine blade, was placed in a fixture to stabilize it. The fixture was set up on a rotary axis such that the blade could be rotated about an axis parallel to the longitudinal axis of the blade. The blade was oriented on the fixture such that the face of the blade platform lay directly on the horizontal reference of the fixture. The fixture was then rotated such that the tangent of the trailing edge surface within 1" of the trailing edge surface was presented 10° off the vertical axis that was coincident with the waterjet nozzle.

Figure 5:
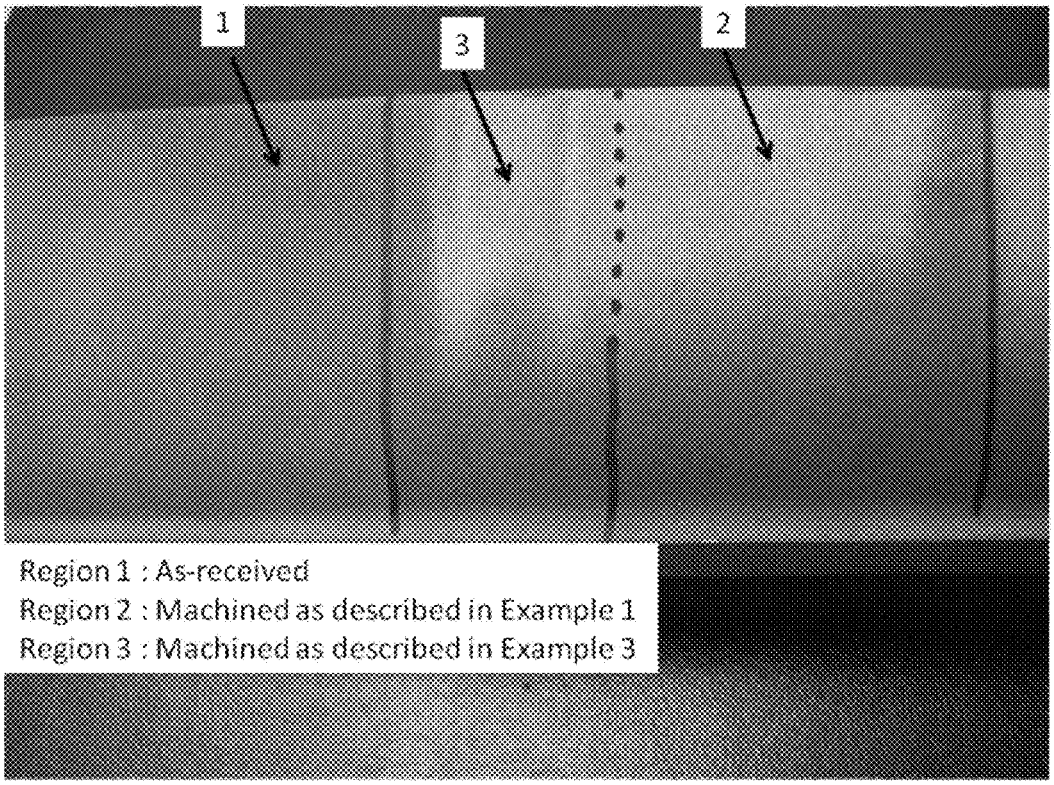
FIG. 5 shows an image of the abrasive water jet machined blade, showing regions 1 (as-received), region 2 (as produced using example 1), and region 3 (as produced using example 3).
Figure 6:
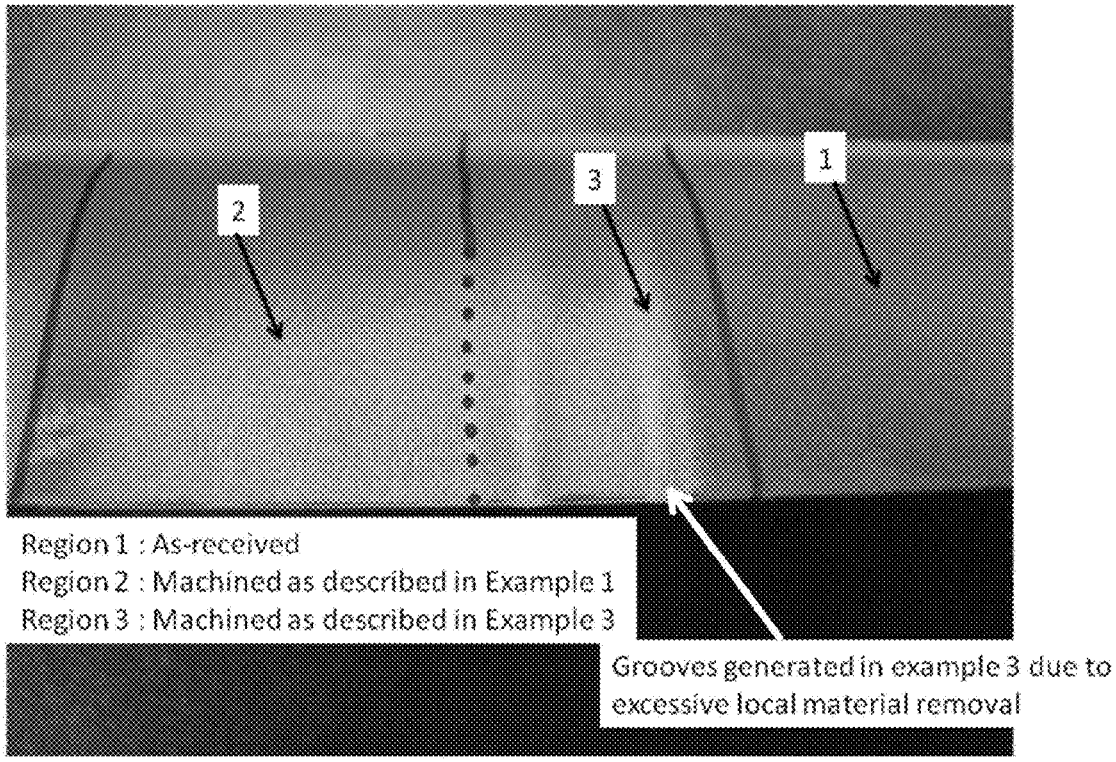
FIG. 6 shows an image of the abrasive water jet machined blade, showing the blade surface and trailing of regions 1 (as-received), region 2 (as produced using example 1), and region 3 (as produced using example 3).
Figure 7:
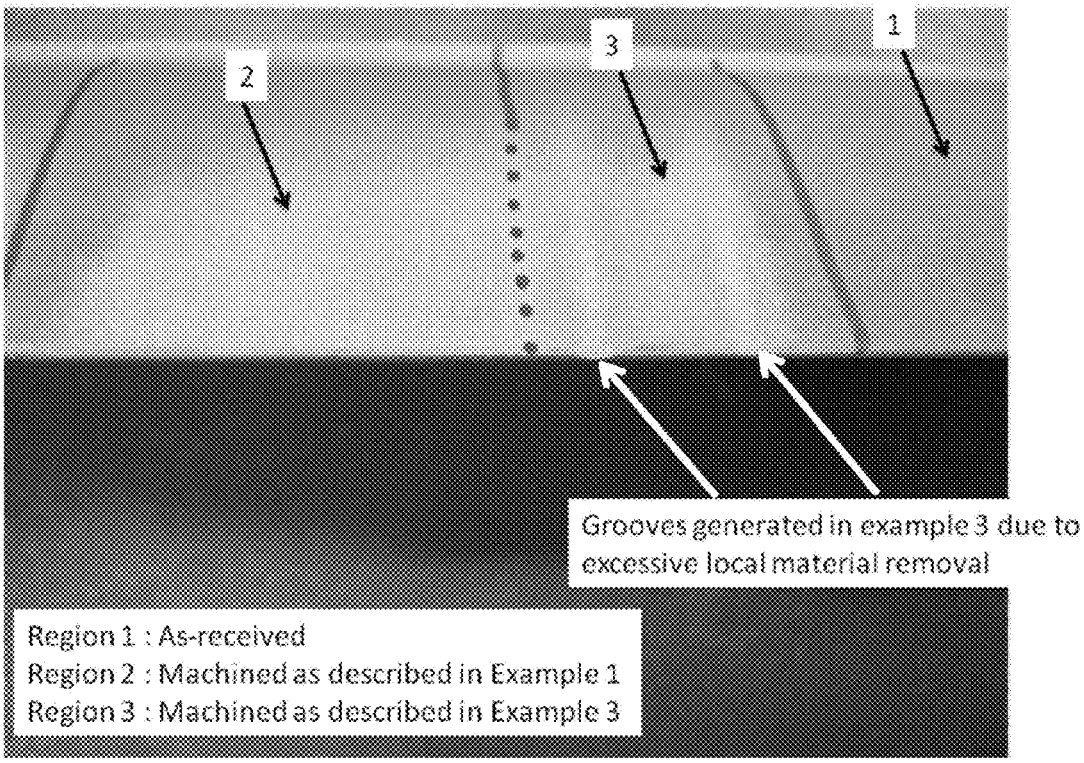
FIG. 7 is an image of the abrasive water jet machined blade, showing the blade trailing region 1 (as-received), region 2 (as produced using example 1), and region 3 (as produced using example 3). The unacceptable control of material removal can be seen in region 3.

Photographic images of the trailing edge of the blade that were machined are shown in FIGS. 5-7. The specific regions of interest are labeled regions 1, 2, and 3 in the images. Region 1 is the original material, and region 2 shows the abrasive water jet machined surface in example 1, as described infra. Region 3 shows the abrasive water jet machined surface in example 3, as described infra. The surfaces finish obtained in example 1 and example 2 are acceptable, and the surface finish obtained in example 3 is not acceptable.

Figure 8A:
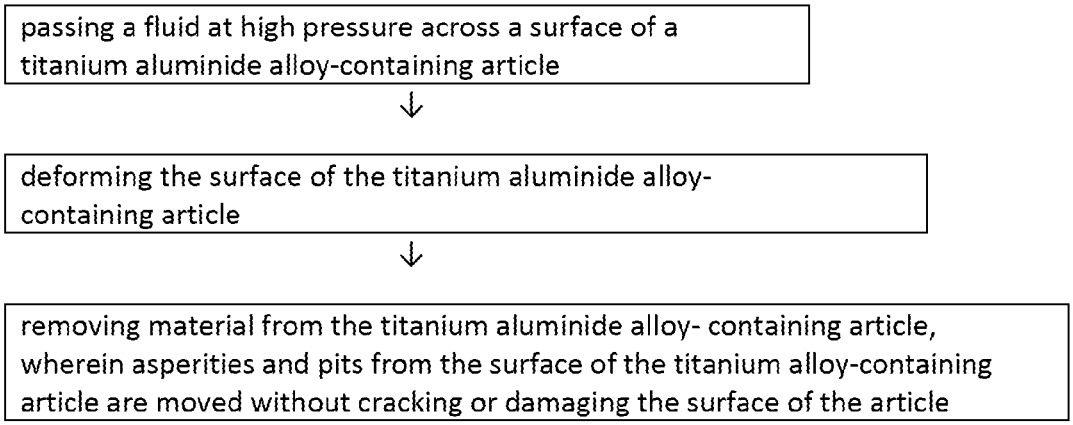
FIGS. 8*a* and 8*b* show flow charts, in accordance with certain aspects of the disclosure for removing material from and improving the surface of a titanium aluminide alloy-containing article.
Figure 8B:
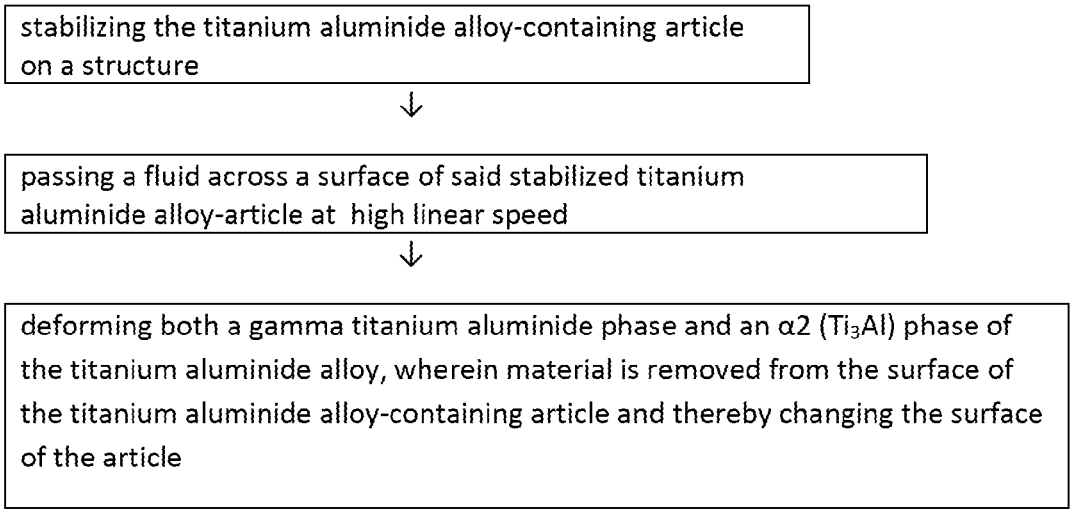

In a first example, the part was brought into glancing contact with the jet, and the jet was moved along the longitudinal axis of the blade in the following mode to successfully remove material from the convex surface of the blade. The jet was oscillated over a region 2" in length parallel with the longitudinal axis of the blade at a maximum feedrate of about 100 inches per minute. Four complete cycles (+2", −2") were performed and the resulting surface is shown in Region 2 in the photographs in FIG. 5-7; these figures show different perspectives of the machined surface. Approximately 0.004" of titanium aluminide was successfully removed in a controlled manner. The original surface before machining can be seen in region 1 in the photographs in FIGS. 5-7. A good surface finish of less than an Ra of 80 microinches was obtained on the abrasive water jet milled surface (e.g. see FIG. 8).

In a second example, the titanium aluminide turbine airfoil was brought into glancing contact with the abrasive water jet, and the jet was moved along the longitudinal axis of the blade in the following mode: the jet was moved continuously at a slow rate of about 1 inch per minute across a traverse length of about 1" parallel with the longitudinal axis of the blade in a separate region of the trailing edge of blade from the first example. Approximately 0.004" of material were successfully removed. A surface finish of less than an Ra of 80 microinches was obtained.

In a third example, the part was brought into glancing contact with the abrasive water jet in a new region of the as-received blade, and the jet was translated along the longitudinal axis of the blade. The motion of the jet across the blade surface was interrupted, and the speed approached zero. When the speed became low and approached zero, the rate of material removal increased substantially, and the ability to control the amount of material removed was reduced. For example, in region 3 as the jet speed approached zero and remained in place for 5 seconds, a maximum of 0.025" of material thickness was removed in an uncontrolled manner; undesirable grooves were generated in the surface of the turbine blade. Unlike the conditions for examples 1 and 2, in example 3, it is not possible to control the rate of material adequately. This machining response can seen on the face of the blade in FIG. 5 and on the trailing edge of the blade in FIGS. 6 and 7.

The abrasive water jet machining operation was performed using a 4 axis computer numerically controlled machine with a conventional high pressure water jet system. In each of the three examples that were described, standard garnet (150-300 micron particle distribution) was employed at 1 pound per minute of mass flow rate and a water pressure of 85,000 pounds per square inch was employed.

This 10° presentation angle of the abrasive water jet to the surface to be milled/machined, represents just one of several presentation angles that are possible depending on the amount of material removal that is desired. In general, the steeper the angle, the smaller the region machined or polished and the faster the operation. A shallower angle will affect a larger linear range of material removal, and remove material slower, allowing finer control. The preferred range of presentation angles is 5 to 20 degrees. In another embodiment, the range of presentation angles is 7 to 12 degrees. In one embodiment, the angle is about 10 degrees.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from their scope. While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled. In the appended claims, the terms “including” and “in which” are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure. It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims. All publications, patents, and patent applications mentioned herein are hereby incorporated by reference in their entirety as if each individual publication or patent was specifically and individually indicated to be incorporated by reference. In case of conflict, the present application, including any definitions herein, will control.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A method for removing material from a titanium aluminide alloy-containing article, comprising:

providing a titanium aluminide alloy-containing article comprising a gamma titanium aluminide-based phase and an $\alpha 2$ ($Ti_3Al$) phase;

passing a fluid at a high pressure across a surface of said titanium aluminide alloy-containing article, wherein particles ranging from about 50 microns to about 400 microns are suspended in the fluid before the fluid is passed across the surface of the article;

deforming the surface of the titanium aluminide alloy-containing article; and removing material from the titanium aluminide alloy-containing article, wherein asperities and pits from the surface of the titanium aluminide alloy-containing article are removed without cracking or damaging the surface of the article.

2. The method as recited in claim 1, wherein the fluid at a high pressure exits a nozzle that moves, and wherein the motion of the nozzle is selected from a group consisting of rotational, translational, oscillatory, or a combination thereof.

3. The method as recited in claim 1, wherein the fluid is selected from a group consisting of water, oil, glycol, alcohol, or a combination thereof.

4. The method as recited in claim 1, wherein the solids loading of the fluid is about 10% to 40% by mass or about 2000 grams per liter to about 5000 grams per liter.

5. The method as recited in claim 1, wherein the fluid is moved at a high linear speed of about 5 inches per minute to about 1000 inches per minute over the surface of the titanium aluminide alloy-containing article.

6. The method as recited in claim 1, wherein passing the fluid at a high pressure across the surface of the titanium aluminide alloy-containing article deforms the surface of the article a depth measured from the surface of the article and perpendicularly into the article of less than about 100 microns.

7. The method as recited in claim 1, wherein the titanium aluminide alloy-containing article is a titanium aluminide alloy-containing turbine blade.

8. The method as recited in claim 1, wherein a roughness of the surface of the article is reduced by at least about 50%.

9. The method as recited in claim 1, wherein the fluid further comprises particles of at least one of alumina, garnet, silica, silicon carbide, boron carbide, diamond, tungsten carbide, and compositions thereof.

10. The method as recited in claim 1, wherein removing material from the titanium aluminide alloy-containing article comprises reducing a roughness of the surface of the article by more than about 50 microinches Ra.

11. The method as recited in claim 1, wherein the method produces a roughness of the surface of the article of less than about two microns.

12. The method as recited in claim 1, wherein the high pressure of the fluid is about 5,000 pounds per square inch to about 10,000 pounds per square inch at the surface of the article.

13. The method as recited in claim 1, wherein the presentation angle of the fluid with respect to the surface of the article is within a range of 7 degrees to 12 degrees.

14. A method for changing a surface of a titanium aluminide alloy-containing article, comprising:

stabilizing the titanium aluminide alloy-containing article on a structure, the titanium aluminide alloy-containing article comprising a gamma titanium aluminide-based phase and an $\alpha 2$ ($Ti_3Al$) phase;

passing a fluid across a surface of said stabilized titanium aluminide alloy-containing article at a high linear speed, wherein particles ranging from about 50 microns to about 400 microns are suspended in the fluid before the fluid is passed across the surface of the article; and deforming both a gamma titanium aluminide based phase and the $\alpha 2$ ($Ti_3Al$) phase of the titanium aluminide alloy, wherein material is removed from the surface of the titanium aluminide alloy-containing article and thereby changing the surface of the article without cracking or damaging the surface of the article.

15. The method as recited in claim 14, wherein the fluid is at a high pressure of about 5,000 pounds per square inch to about 10,000 pounds per square inch at the surface of the article.

16. The method as recited in claim 14, wherein the high linear speed is about 5 inches per minute to about 1000 inches per minute.

17. The method as recited in claim 14, wherein the fluid is at a high pressure, and wherein passing the high pressure fluid across the surface of the titanium aluminide alloy-containing article deforms the surface of the article a depth measured from the surface of the article and perpendicularly into the article of less than about 100 microns.

18. The method as recited in claim 14, wherein the titanium aluminide alloy-containing article is a titanium aluminide alloy-containing turbine blade.

19. The method as recited in claim 14, wherein a roughness of the surface of the article is reduced by at least about 50%.

20. The method as recited in claim 14, wherein the fluid is at a high pressure and further comprises particles of at least one of alumina, garnet, silica, silicon carbide, boron carbide, diamond, tungsten carbide, and compositions thereof.

21. The method as recited in claim 14, wherein the fluid is selected from a group consisting of water, oil, glycol, alcohol, or a combination thereof.

22. The method as recited in claim 14, wherein the solids loading of the fluid is about 10% by 40% by mass or about 2000 grams per liter to about 5000 grams per liter.

23. The method as recited in claim 14, wherein the method reduces a Ra value of the surface of the article by a factor of about three to about six.

24. The method as recited in claim 14, wherein the method produces a roughness of the surface of the article of less than about two microns.

25. The method as recited in claim 14, wherein the presentation angle of the fluid with respect to the surface of the article is within a range of 7 degrees to 12 degrees.

26. A method for machining a surface of an article, said method comprising:

providing a titanium aluminide alloy-containing article comprising a gamma titanium aluminide-based phase and an $\alpha 2$ ($Ti_3Al$) phase;

passing a fluid at a high pressure across a surface of said titanium aluminide alloy-containing article at a presentation angle within a range of 7 degrees to 12 degrees, wherein particles ranging from about 50 microns to about 400 microns are suspended in the fluid before the fluid is passed across the surface of the article;

deforming the surface of the titanium aluminide alloy-containing article; and removing material from the surface of the titanium aluminide alloy-containing article without cracking or damaging the surface of the article.

27. The method as recited in claim 26, wherein the fluid is passed at a high linear speed over the surface of the article, wherein the high linear speed is about 5 inches per minute to about 1000 inches per minute.

28. The method as recited in claim 26, wherein the fluid is at a high pressure, and wherein passing the high pressure fluid across the surface of the titanium aluminide alloy-containing article deforms the surface of the article a depth measured from the surface of the article and perpendicularly into the article of less than about 100 microns.

29. The method as recited in claim 26, wherein the titanium aluminide alloy-containing article is a titanium aluminide alloy-containing turbine blade.

30. The method as recited in claim 26, wherein the fluid at high pressure further comprises particles of at least one of alumina, garnet, silica, silicon carbide, boron carbide, diamond, tungsten carbide, and compositions thereof.

31. The method as recited in claim 26, wherein the high pressure of the fluid is about 5,000 pounds per square inch to about 10,000 pounds per square inch at the surface of the article.

32. A method for removing overstock material from a convex surface of a titanium aluminide alloy-containing turbine blade, said method comprising:

passing a fluid at a high pressure across a convex surface of a titanium aluminide alloy-containing turbine blade comprising a gamma titanium aluminide-based phase and an $\alpha 2$ ($Ti_3Al$) phase at a presentation angle within a range of 7 degrees to 12 degrees, wherein particles ranging from about 50 microns to about 400 microns are suspended in the fluid before the fluid is passed across the convex surface of the blade; and removing about 0.025 mm to about 5.0 mm of overstock material from the convex surface of the titanium aluminide alloy-containing turbine blade without cracking or damaging the surface of the turbine blade.

33. The method as recited in claim 32, wherein the high pressure of the fluid is about 5,000 pounds per square inch to about 10,000 pounds per square inch at the surface of the article, and wherein the fluid is passed at a high linear speed of about 5 inches per minute to about 1000 inches per minute over the surface of the turbine blade.

* * * * *